US011596286B2

(12) United States Patent
Sutter et al.

(10) Patent No.: US 11,596,286 B2
(45) Date of Patent: Mar. 7, 2023

(54) WHEEL ASSEMBLY FOR ROBOTIC CLEANER AND ROBOTIC CLEANER HAVING THE SAME

(71) Applicant: SharkNinja Operating, LLC, Needham, MA (US)

(72) Inventors: Catriona C. A. Sutter, Brookline, MA (US); Ming Yao, Suzhou (CN); William Wang, Needham, MA (US); Andre D. Brown, Natick, MA (US)

(73) Assignee: SharkNinja Operating LLC, Needham, MA (US)

( * ) Notice: Subject to any disclaimer, the term of this patent is extended or adjusted under 35 U.S.C. 154(b) by 332 days.

(21) Appl. No.: 16/728,077

(22) Filed: Dec. 27, 2019

(65) Prior Publication Data

US 2020/0205634 A1 Jul. 2, 2020

Related U.S. Application Data

(60) Provisional application No. 62/785,884, filed on Dec. 28, 2018.

(51) Int. Cl.
*A47L 11/40* (2006.01)

(52) U.S. Cl.
CPC ..... *A47L 11/4072* (2013.01); *A47L 11/4066* (2013.01); *A47L 2201/00* (2013.01)

(58) Field of Classification Search
CPC ..... A47L 11/4066; A47L 11/4072; A47L 2201/00
See application file for complete search history.

(56) References Cited

U.S. PATENT DOCUMENTS

| | | | |
|---|---|---|---|
| 8,474,090 | B2 | 7/2013 | Jones et al. |
| 9,883,778 | B2 | 2/2018 | Vanderstegen-Drake et al. |
| 10,362,921 | B2 | 7/2019 | Youk et al. |
| 2006/0005344 | A1 | 1/2006 | Uehigashi |
| 2007/0016328 | A1* | 1/2007 | Ziegler ..... G05D 1/0219 701/23 |
| 2013/0054026 | A1 | 2/2013 | Jang et al. |
| 2013/0087393 | A1 | 4/2013 | Vanderstegen-Drake et al. |
| 2013/0340201 | A1 | 12/2013 | Jang et al. |

(Continued)

FOREIGN PATENT DOCUMENTS

| | | |
|---|---|---|
| CN | 102990666 | 3/2013 |
| CN | 204260679 | 4/2015 |

(Continued)

OTHER PUBLICATIONS

PCT Search Report and Written Opinion dated Feb. 28, 2020, received in PT Application No. PCT/US19/68662, 10 pgs.

(Continued)

*Primary Examiner* — Randall E Chin
(74) *Attorney, Agent, or Firm* — Grossman Tucker Perreault & Pfleger, PLLC

(57) ABSTRACT

A wheel assembly for a robotic cleaner may include a frame, a moveable arm pivotally coupled to the frame, a driven wheel rotatably coupled to the moveable arm such that the driven wheel pivots with the moveable arm, and a biasing mechanism configured to urge the driven wheel towards an extended position, the biasing mechanism being coupled to the frame and spaced apart from the moveable arm.

19 Claims, 14 Drawing Sheets

(56) References Cited

U.S. PATENT DOCUMENTS

| | | | | |
|---|---|---|---|---|
| 2014/0076642 | A1 | 3/2014 | Gettings et al. | |
| 2016/0166127 | A1* | 6/2016 | Lewis | A47L 9/0477 15/49.1 |
| 2019/0039428 | A1* | 2/2019 | Ebrahimi Afrouzi | B60G 21/051 |
| 2020/0238836 | A1 | 7/2020 | Cheng et al. | |

FOREIGN PATENT DOCUMENTS

| | | |
|---|---|---|
| CN | 105142478 | 12/2015 |
| CN | 108784537 | 11/2018 |
| GB | 1084870 A | 9/1967 |
| GB | 2497452 A | 6/2013 |

OTHER PUBLICATIONS

Chinese Office Action with English translation dated Feb. 16, 2022, received in Chinese Patent Application No. 201980092800.1, 9 pages.

Chinese Office Action with machine-generated English translation, dated Oct. 31, 2022, received in Chinese Patent Application No. 201980092800.1, 17 pages.

* cited by examiner

WHEEL ASSEMBLY FOR ROBOTIC CLEANER AND ROBOTIC CLEANER HAVING THE SAME

CROSS-REFERENCE TO RELATED APPLICATIONS

The present application claims the benefit of U.S. Provisional Application Ser. No. 62/785,884 filed on Dec. 28, 2018, entitled Wheel Assembly for Robotic Cleaner, which is fully incorporated herein by reference.

TECHNICAL FIELD

The present disclosure is generally related to robotic cleaners and more specifically related to a wheel assembly for a robotic cleaner.

BACKGROUND INFORMATION

Robotic cleaners (e.g., robotic vacuum cleaners) are configured to autonomously clean a surface. For example, a user of a robotic vacuum cleaner may locate the robotic vacuum cleaner in an environment and instruct the robotic vacuum cleaner to commence a cleaning operation. While cleaning, the robotic vacuum cleaner collects debris and deposits it in a dust cup for later disposal by a user. The robotic vacuum cleaner may be configured to automatically dock with a docking station to recharge one or more batteries powering the robotic vacuum cleaner and/or to empty the dust cup.

BRIEF DESCRIPTION OF THE DRAWINGS

These and other features and advantages will be better understood by reading the following detailed description, taken together with the drawings, wherein.

DETAILED DESCRIPTION

The present disclosure is generally related to a wheel assembly for a robotic cleaner (e.g., a robotic vacuum cleaner). The wheel assembly includes a frame configured to be coupled to the robotic cleaner. A driven wheel is configured to pivot relative to the frame. A biasing mechanism, such as a torsion spring, is coupled to the frame such that the driven wheel is biased in a direction away from the frame towards an extended position (e.g., in a direction of a surface to be cleaned). A torsion spring may provide a more consistent spring force as the driven wheel transitions towards the extended position when compared to, for example, a tension spring.

The frame can be configured to be coupled to a portion of a body of the robotic cleaner such that the driven wheel supports at least a portion of the body. The body can include a chassis and a housing, the housing being configured to be coupled to the chassis of the robotic cleaner (e.g., such that at least a portion of the housing extends around at least a portion of the chassis). In some instances, the biasing mechanism may be coupled to the body instead of or in addition to being coupled to the frame of the wheel assembly.

Engage, as used herein, may refer to direct or indirect engagement unless explicitly stated otherwise.

Figure 1:
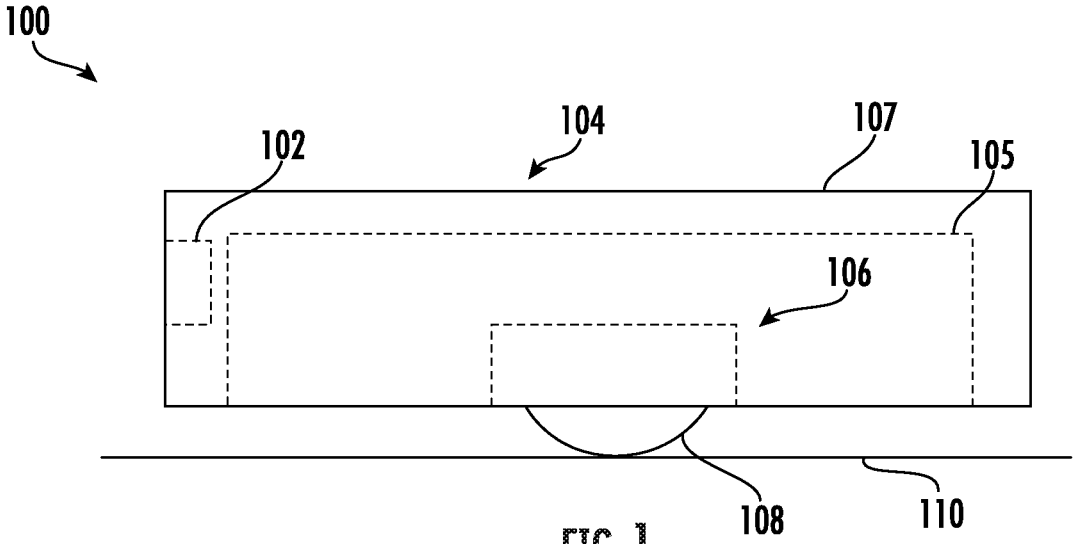
FIG. 1 is a schematic view of an example of a robotic cleaner, consistent with embodiments of the present disclosure.

FIG. 1 shows a schematic example of a robotic cleaner 100 (e.g., a robotic vacuum cleaner). The robotic cleaner 100 includes one or more sensors 102 (shown in hidden lines), a body 104, and a wheel assembly 106 (shown in hidden lines) coupled to the body 104. The body 104 includes a chassis 105 (shown in hidden lines) and a housing 107. The housing 107 may be coupled to the chassis 105 such that the housing 107 at least partially encloses at least a portion of the chassis 105. The wheel assembly 106 is configured to be coupled to the body 104 and includes a driven wheel 108 that is biased in a direction of a surface to be cleaned 110 (e.g., a floor). The driven wheel 108 is configured to urge the body 104 of the robotic cleaner 100 across the surface to be cleaned 110. In some instances, the driven wheel 108 may form part of a continuous track drive system that is configured to urge the robotic cleaner 100 over the surface to be cleaned 110.

Figure 2A:
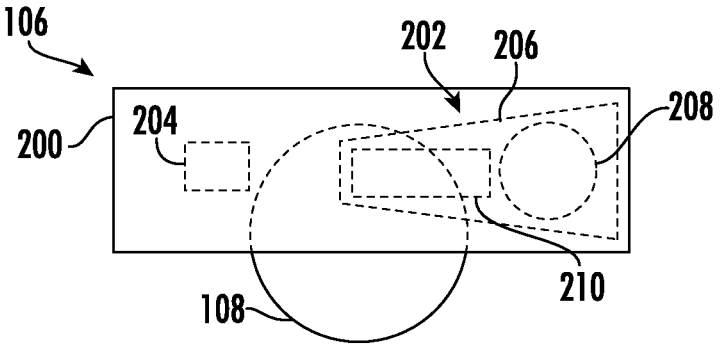
FIG. 2A is a schematic view of an example of a wheel assembly capable of being used with the robotic cleaner of FIG. 1, consistent with embodiments of the present disclosure.

FIG. 2A shows a schematic example of the wheel assembly 106. As shown, the wheel assembly 106 has a frame 200 having a power train 202, a biasing mechanism 204 (e.g., a spring such as a torsion spring, leaf spring, compression spring, or tension spring), a moveable arm 206, and the driven wheel 108 coupled thereto. The power train 202 is coupled to the arm 206 and includes a drive motor 208 and a drive train 210. The drive train 210 is configured to transmit power from the drive motor 208 to the driven wheel 108 such that the driven wheel 108 urges the robotic cleaner 100 across the surface to be cleaned 110.

The arm 206 can be pivotally coupled to the frame 200 of the wheel assembly 106 such that the arm 206 can pivot relative to the frame 200. As such, as the arm 206 pivots, the power train 202 (e.g., the drive motor 208 and the drive train 210) pivots with the arm 206. The driven wheel 108 is rotatably coupled to the arm 206 such that the driven wheel 108 pivots with the arm 206. As such, as the arm 206 pivots, the drive motor 208 continues to transmit power to the driven wheel 108 via the drive train 210.

The biasing mechanism 204 directly or indirectly engages the driven wheel 108 and is configured to urge the driven wheel 108 in a direction away from the frame 200 of the wheel assembly 106 towards an extended position. As such, the biasing mechanism 204 can be configured such that it does not substantially interfere with the rotation of the driven wheel 108. For example, the biasing mechanism 204 can directly or indirectly engage an axle of the driven wheel 108 such that the axle rotates relative to the biasing mechanism 204.

Figure 2B:
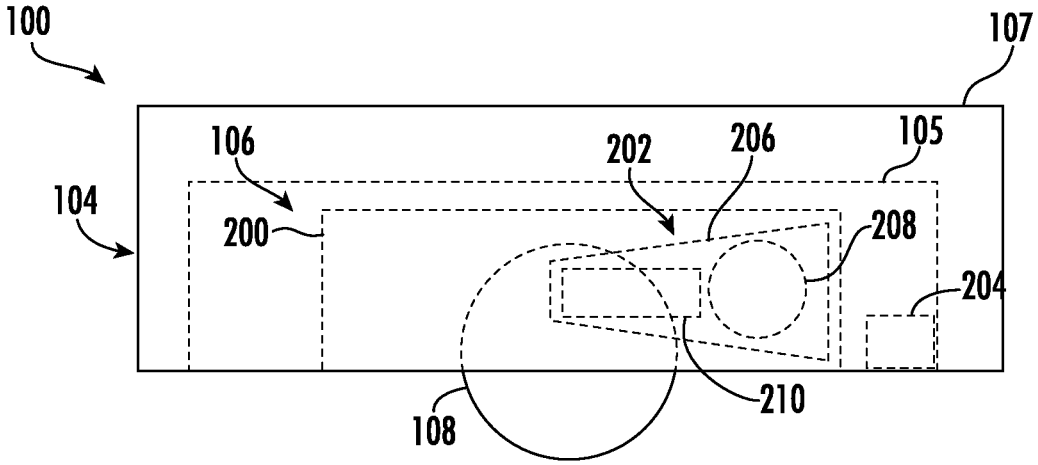
FIG. 2B is a schematic view of an example of the robotic cleaner of FIG. 1, consistent with embodiments of the present disclosure.

FIG. 2B shows an example of the wheel assembly 106, wherein at least a portion of the biasing mechanism 204 is coupled to the body 104 (e.g., the chassis 105 and/or the housing 107) of the robotic cleaner 100. As shown, the wheel assembly 106 includes the frame 200 having the power train 202, the arm 206, and the driven wheel 108 coupled thereto. In some instances, when at least a portion of the biasing mechanism 204 is coupled to the body 104, at least a portion of the frame 200 may be integrally formed from at least a portion of the body 104. The power train 202 is coupled to the arm 206 and includes the drive motor 208 and the drive train 210. The drive train 210 is configured to transmit power from the drive motor 208 to the driven wheel 108 such that the driven wheel 108 urges the robotic cleaner 100 across the surface to be cleaned 110.

The arm 206 can be pivotally coupled to the frame 200 of the wheel assembly 106 such that the arm 206 can pivot relative to the frame 200. As such, as the arm 206 pivots, the drive motor 208 and the drive train 210 pivot with the arm 206. The driven wheel 108 is rotatably coupled to the arm 206 such that the driven wheel 108 pivots with the arm 206. As such, as the arm 206 pivots, the drive motor 208 continues to transmit power to the driven wheel 108 via the drive train 210.

The biasing mechanism 204 directly or indirectly engages the driven wheel 108 and is configured to urge the driven wheel 108 in a direction away from the frame 200 of the wheel assembly 106 towards an extended position. As such, the biasing mechanism 204 can be configured such that it does not substantially interfere with the rotation of the driven wheel 108. For example, the biasing mechanism 204 can directly or indirectly engage an axle of the driven wheel 108 such that the axle rotates relative to the biasing mechanism 204.

Figure 3:
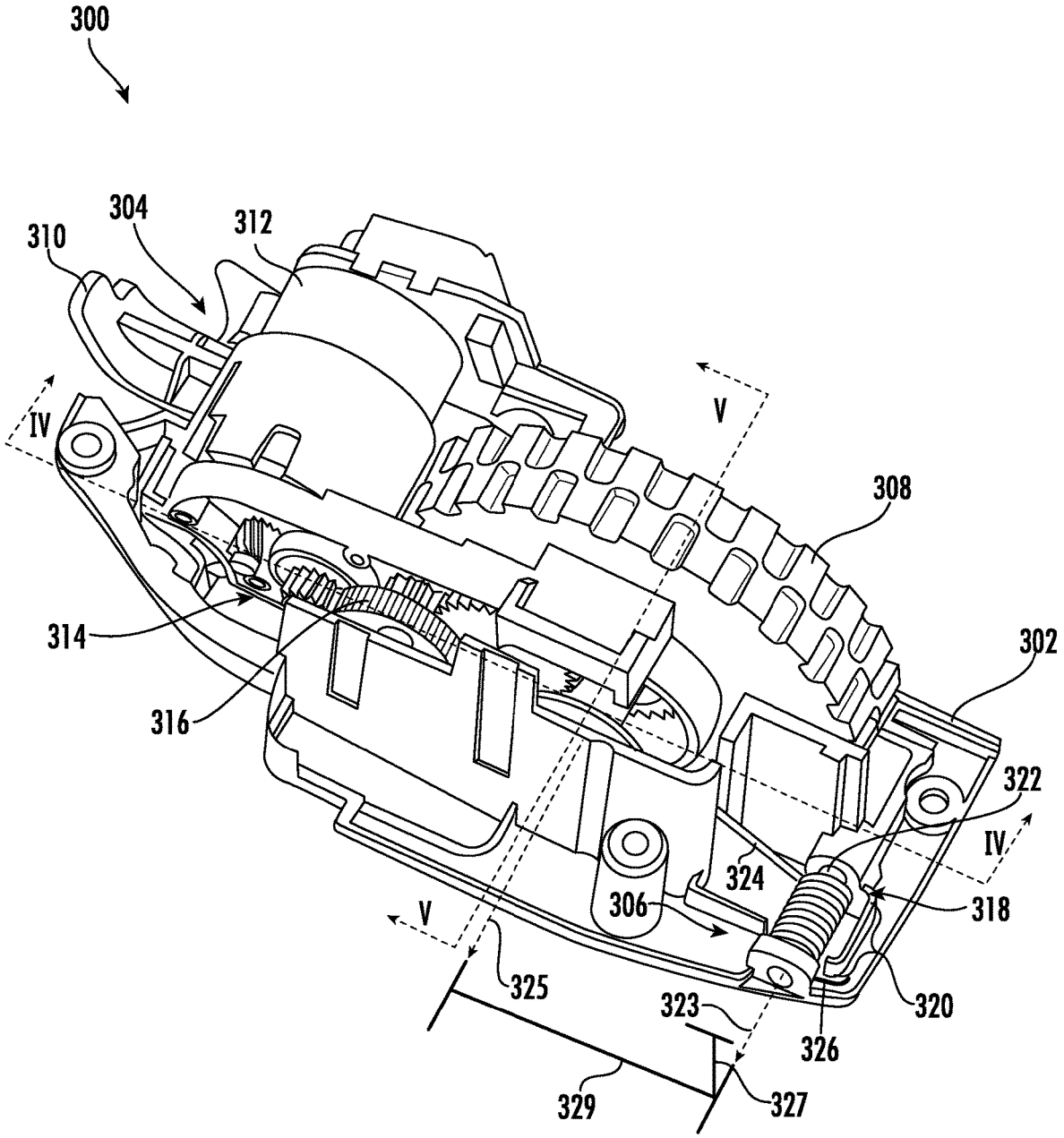
FIG. 3 is a perspective view of an example of a wheel assembly, consistent with embodiments of the present disclosure.

FIG. 3 shows a perspective view of a wheel assembly 300, which may be an example of the wheel assembly 106 of FIG. 1. As shown, the wheel assembly 300 includes a frame 302. The frame 302 has a power train 304, a biasing mechanism 306, a driven wheel 308, and an arm 310 coupled thereto. The power train 304 is coupled to the arm 310 and includes a drive motor 312 and a drive train 314. The drive train 314 includes one or more gears 316 configured to transmit power to the driven wheel 308. Additionally, or alternatively, the drive train 314 can include one or more belts configured to transmit power to the driven wheel 308.

The arm 310 is pivotally coupled to the frame 302 of the wheel assembly 300 such that the arm 310 can pivot relative to the frame 302. The drive motor 312 and the drive train 314 are configured to pivot with the arm 310. The driven wheel 308 can be rotatably coupled to the arm 310 such that, as the arm 310 pivots relative to the frame 302, the drive motor 312 continues to transmit power to the driven wheel 308 via the drive train 314.

The biasing mechanism 306 includes a torsion spring 318, the torsion spring 318 being coupled to the frame 302 of the wheel assembly 300 and being spaced apart from the arm 310. As shown, the torsion spring 318 includes a coiled portion 320 that extends around a pin 322 coupled to the frame 302 of the wheel assembly 300. The pin 322 extends generally along a spring axis 323 of the coiled portion 320. During operation, the arm 310 may pivot such that a rotation axis 325 of the driven wheel 308 transitions between a position vertically above the pin 322 and a position vertically below the pin 322. The pin 322 can be positioned on the frame 302 at a location between the axis of rotation 325 of the driven wheel 308 and a surface to be cleaned that maximizes a separation distance (e.g., a vertical and/or horizontal separation distance 327 and 329) between the pin 322 and the axis of rotation 325 of the driven wheel 308 when the driven wheel 308 is in a retracted position. In some instances, the pin 322 can be coupled to the frame 302 at a location that minimizes a separation distance between the pin 322 and the surface to be cleaned. As such, the pin 322 may be positioned such that a separation distance between the spring axis 323 of the coiled portion 320 of the torsion spring 318 and the axis of rotation 325 of the driven wheel 308 is maximized for any given position of the driven wheel 308 relative to the frame 302.

The torsion spring 318 includes a first spring arm 324 configured to directly or indirectly engage at least a portion of the driven wheel 308 such that the first spring arm 324 urges the driven wheel 308 in a direction away from the frame 302 of the wheel assembly 300 towards an extended position and a second spring arm 326 configured to directly or indirectly engage the frame 302 of the wheel assembly 300. The first spring arm 324 of the torsion spring 318 engages the driven wheel 308 such that the first spring arm 324 does not substantially interfere with rotation of the driven wheel 308.

Figure 4:
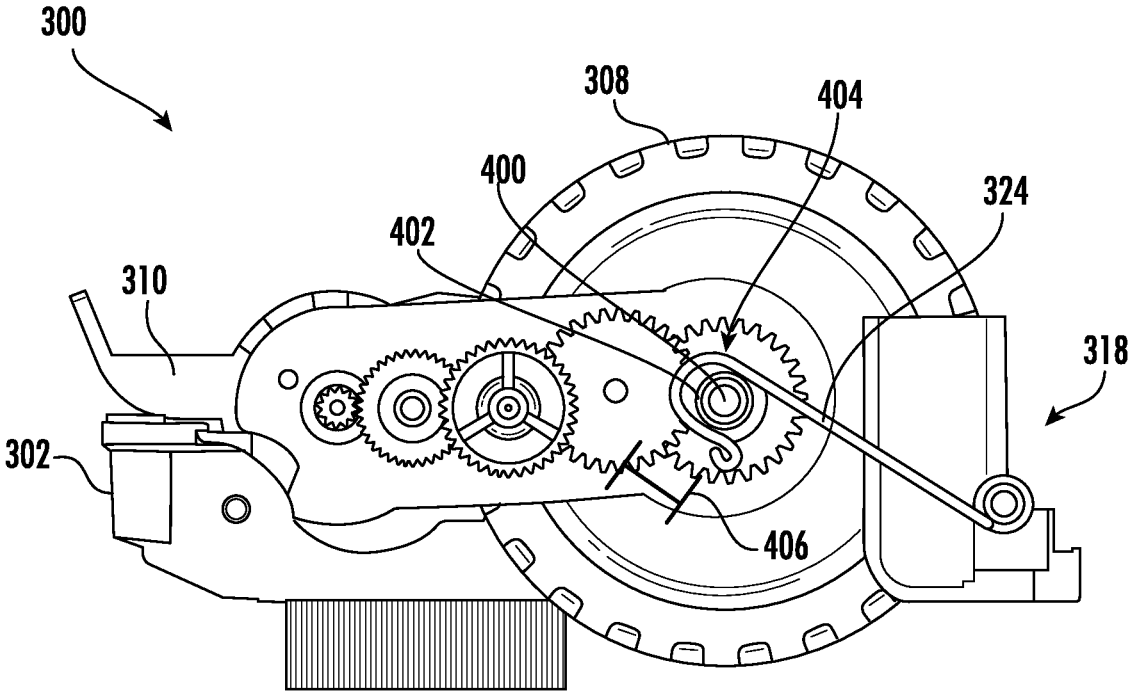
FIG. 4 is a cross-sectional side view of the wheel assembly of FIG. 3 taken along the line IV-IV, consistent with embodiments of the present disclosure.

FIG. 4 is a cross-sectional side view of the wheel assembly 300 taken along the line IV-IV of FIG. 3. The driven wheel 308 is shown in a retracted position. When in the retracted position, the first spring arm 324 of the torsion spring 318 urges the driven wheel 308 towards an extended position. As the driven wheel 308 moves towards the extended position, the arm 310 is caused to pivot relative to the frame 302 of the wheel assembly 300. When engaging a surface to be cleaned, the driven wheel 308 may be disposed at an intermediary position between the retracted and extended position. As such, as the driven wheel 308 traverses a surface to be cleaned, the driven wheel 308 may move relative to the frame 302 of the wheel assembly 300 in response to changes in a surface to be cleaned.

As shown, the driven wheel 308 includes an axle 400 extending therefrom. The axle 400 is coupled to the driven wheel 308 such that a rotation of the axle 400 causes a corresponding rotation in the driven wheel 308. In other words, the axle 400 can be coupled to the driven wheel 308 such that the axle 400 rotates with the driven wheel 308. A spring arm bushing 402 can extend around the axle 400 such that the axle 400 is capable of rotation relative to the spring arm bushing 402. The first spring arm 324 of the torsion spring 318 can directly or indirectly engage the spring arm bushing 402 such that the first spring arm 324 exerts a force on the spring arm bushing 402 and urges the driven wheel 308 towards the extended position.

As also shown, the first spring arm 324 may include a hooked portion 404 that extends at least partially around the spring arm bushing 402. As the arm 310 pivots, the spring arm bushing 402 slideably engages the hooked portion 404 of the first spring arm 324. As such, a longitudinal length 406 of the hooked portion 404 may correspond to a sliding distance of the spring arm bushing 402 along the first spring arm 324. For example, as the arm 310 pivots, the spring arm bushing 402 may move in a direction towards and away from each distal end of the hooked portion 404. In some instances, the maximum (and/or minimum) extension distance of the driven wheel 308, when in the extended position, may be based, at least in part, on the longitudinal length 406 of the hooked portion 404.

Figure 5:
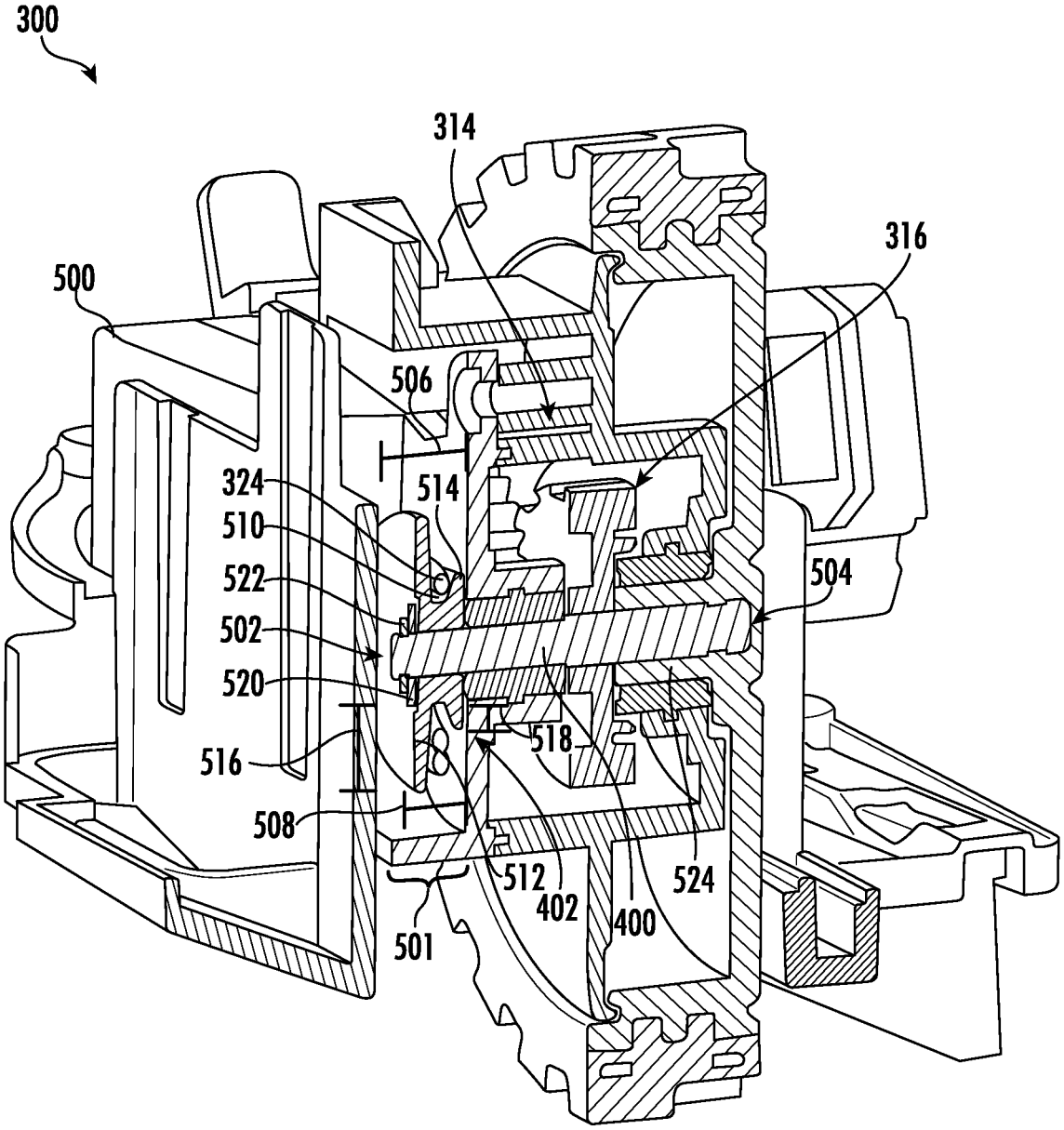
FIG. 5 is a cross-sectional perspective view of the wheel assembly of FIG. 3 taken along the line V-V, consistent with embodiments of the present disclosure.

FIG. 5 shows a perspective cross-sectional view of the wheel assembly 300 taken along the line V-V of FIG. 3. As shown, the drive train 314 can include a drive train cover 500 that extends over the gears 316. The drive train cover 500 can reduce or prevent the ingress of debris into the drive train 314 that may interfere with, for example, the rotation of one or more of the gears 316.

As shown, a first end 502 of the axle 400 extends through the drive train cover 500 and a second end 504 of the axle 400 is coupled to the driven wheel 308. At least one of the gears 316 forming the drive train 314 can be configured to engage a drive gear coupled to the axle 400 at a location between the first and second ends 502 and 504 such that the axle 400 rotates in response to the rotation of the gears 316 forming the drive train 314.

The first end 502 of the axle 400 can extend from the drive train cover 500 by an extension distance 506. The extension distance 506 can measure equal to or greater than a width 508 of the spring arm bushing 402. As such, the spring arm bushing 402 can be disposed along the axle 400 at a location between the first end 502 of the axle 400 and at least a portion the drive train cover 500. In some instances, a portion of the drive train cover 500 may define a recessed region 501 configured to receive at least a portion of the spring arm bushing 402. Therefore, the first spring arm 324 extends around the spring arm bushing 402 at a location between the first end 502 of the axle 400 and the drive train cover 500.

The spring arm bushing 402 can define a track 510 having a first and second sidewall 512 and 514 on opposing sides of the track 510, the second sidewall 514 being disposed between the first sidewall 512 and the drive train cover 500. The track 510 is configured to receive the first spring arm 324. The first sidewall 512 can have a first sidewall height 516 that measures greater than a second sidewall height 518 of the second sidewall 514. By having the first sidewall height 516 measure greater than the second sidewall height 518, the first spring arm 324 may be prevented from inadvertently disengaging the spring arm bushing 402.

As shown, a washer 520 and a snap ring 522 can be disposed between the first end 502 of the axle 400 and the spring arm bushing 402. The washer 520 and the snap ring 522 can be configured to couple the spring arm bushing 402 to the axle 400 such that the axle 400 can rotate relative to the spring arm bushing 402. In some instances, the spring arm bushing 402 can be coupled to the axle 400 such that the spring arm bushing 402 rotates with the axle 400 and relative to the first spring arm 324.

The second end 504 of the axle 400 is coupled to the driven wheel 308 such that the axle 400 rotates together with the driven wheel 308. The driven wheel 308 includes a hub 524 configured to receive the second end 504 of the axle 400 such that the axle 400 is coupled to the driven wheel 308. For example, and as shown, the driven wheel 308 can be over-molded over at least a portion of the axle 400 such that the second end 504 of the axle 400 is disposed within the hub 524. Additionally, or alternatively, the axle 400 can be coupled to the driven wheel 308 by one or more of one or more adhesives, one or more mechanical couplings (e.g., screws, bolts, and/or any other mechanical coupling), a press-fit, and/or any other form of coupling.

Figure 6:
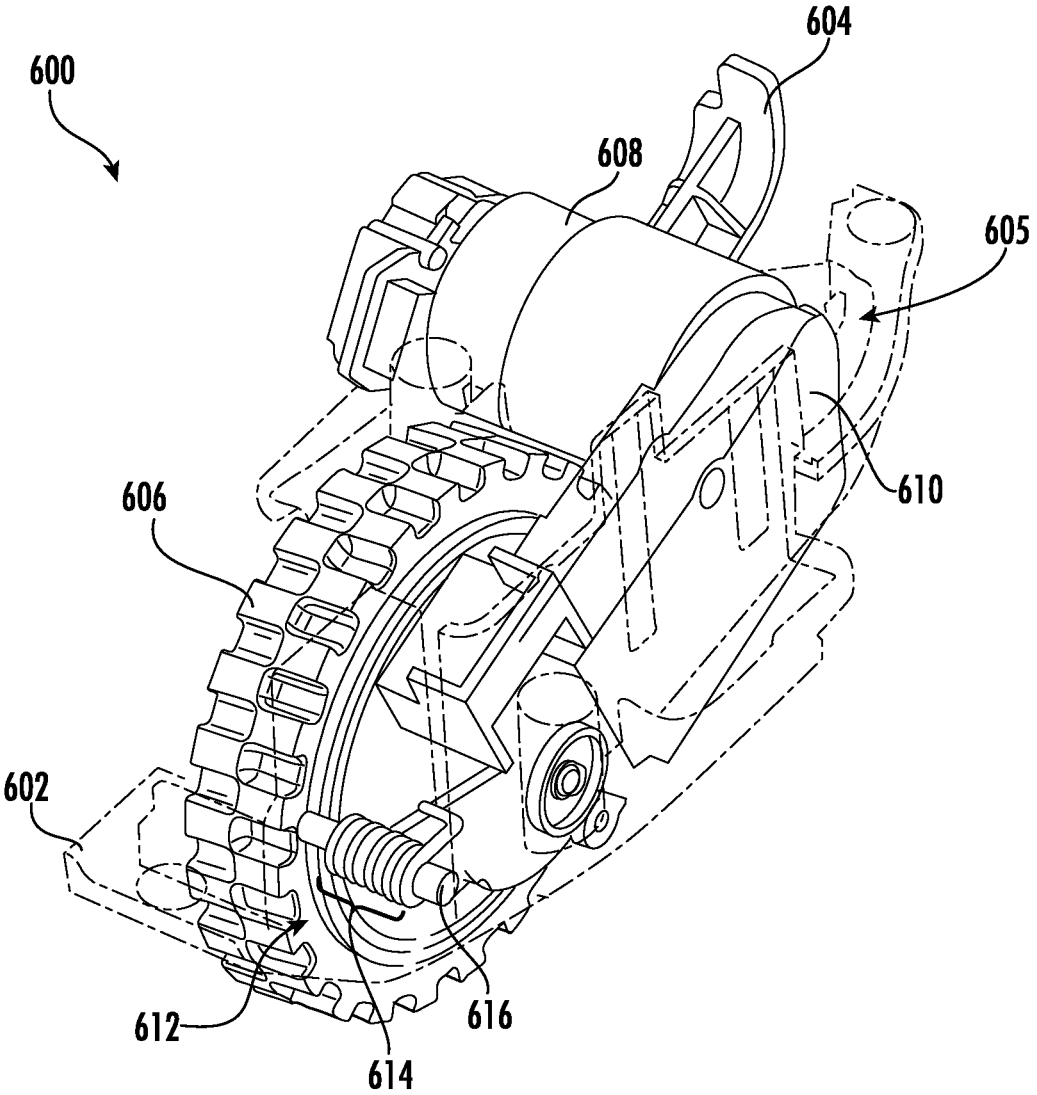
FIG. 6 is a perspective view of an example of a wheel assembly, consistent with embodiments of the present disclosure.

FIG. 6 shows a perspective view of an example of a wheel assembly 600, which may be an example of the wheel assembly 106 of FIG. 1. As shown, the wheel assembly 600 includes a frame 602 and an arm 604 pivotally coupled to the frame 602. A power train 605 is coupled to the arm 604 such that the power train 605 pivots with the arm 604. The power train 605 includes a drive motor 608 and a drive train 610, the drive train 610 being configured to transmit power from the drive motor 608 to a driven wheel 606. The driven wheel 606 is rotatably coupled to the arm 604 such that the driven wheel 606 pivots with the arm 604. As such, the drive train 610 continues to transmit power from the drive motor 608 to the driven wheel 606 while the arm 604 pivots.

As also shown, the wheel assembly 600 includes a torsion spring 612 configured to urge the driven wheel 606 towards an extended position (e.g., in a direction of a surface to be cleaned). The torsion spring 612 includes a coiled portion 614 that extends around a pin 616 coupled to the frame 602 of the wheel assembly 600.

Figure 7:
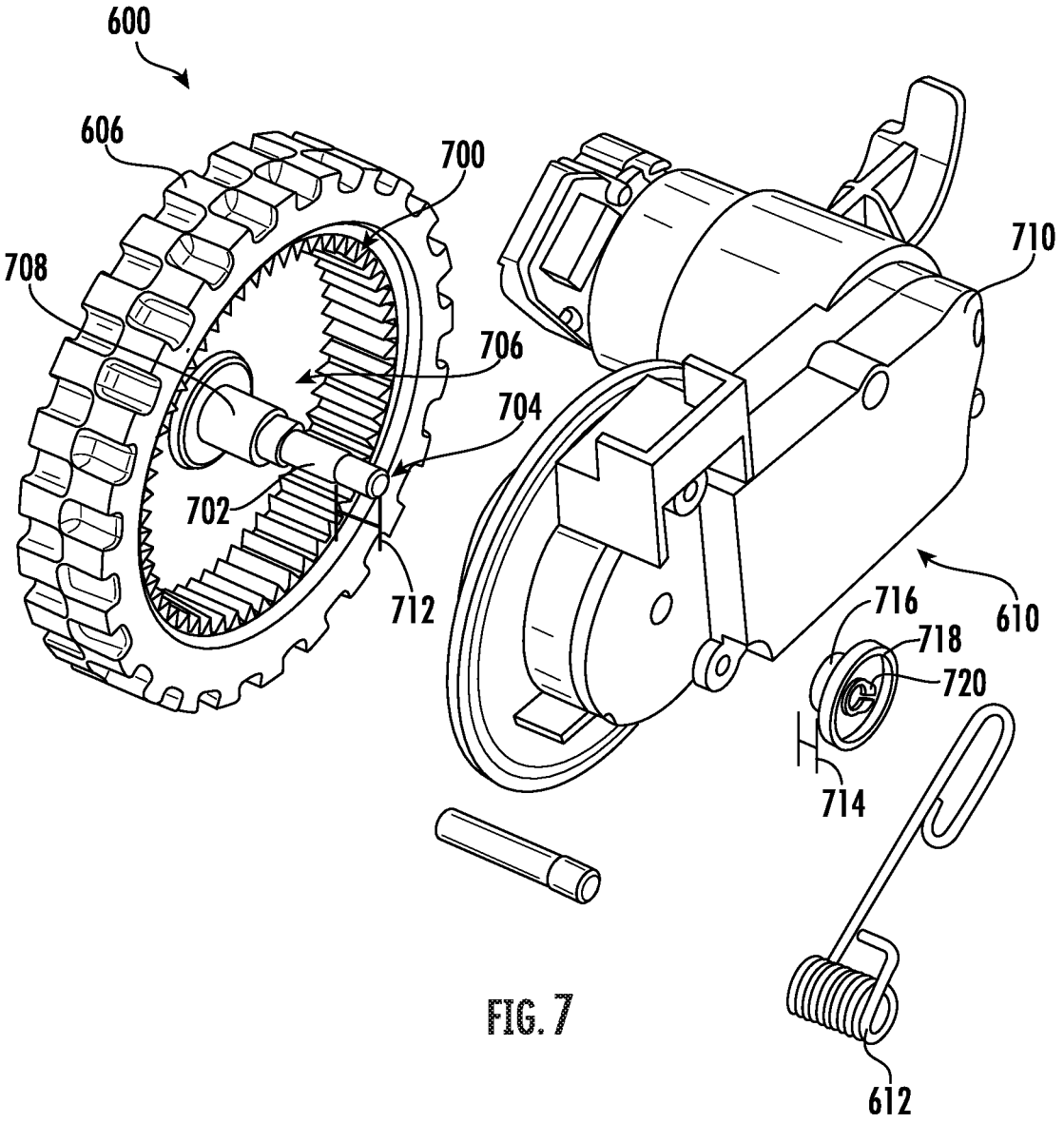
FIG. 7 is an exploded perspective view of the wheel assembly of FIG. 6, consistent with embodiments of the present disclosure.

FIG. 7 shows an exploded perspective view of the wheel assembly 600 of FIG. 6 having the frame 602 removed therefrom. As shown, an interior surface 700 of the driven wheel 606 can define a planet gear configured to engage a corresponding sun gear (not shown) of the drive train 610. Rotation of the sun gear causes a corresponding rotation of the driven wheel 606. In some instances, a drive gear can be coupled to an axle 702 extending from the driven wheel 606 such that a rotation of the drive gear causes a corresponding rotation of the driven wheel 606.

The axle 702 includes a first and a second end 704 and 706. The second end 706 of the axle 702 is received within a hub 708 of the driven wheel 606 such that the axle 702 is coupled to the driven wheel 606. As such, the driven wheel 606 is configured to rotate with the axle 702. The hub 708 can be over-molded over at least a portion of the axle 702. Additionally, or alternatively, the axle 702 can be coupled to the driven wheel 606 by one or more of one or more adhesives, one or more mechanical couplings (e.g., screws, bolts, and/or any other mechanical coupling), a press-fit, and/or any other form of coupling.

The first end 704 of the axle 702 extends from a drive train cover 710 by an extension distance 712. The extension distance 712 may measure equal to or greater than a width 714 of a spring arm bushing 716 extending around the axle 702 at a location between the first end 704 and the drive train cover 710. The spring arm bushing 716 can be configured to engage the torsion spring 612 such that the axle 702 can rotate relative to the torsion spring 612 without the torsion spring 612 substantially interfering with the rotation. A washer 718 and a snap ring 720 can be disposed along the axle 702 at a location between the spring arm bushing 716 and the first end 704 of the axle 702. The washer 718 and the snap ring 720 can be configured to couple the spring arm bushing 716 to the axle 702 such that the axle 702 can rotate relative to the spring arm bushing 716.

Figure 8:
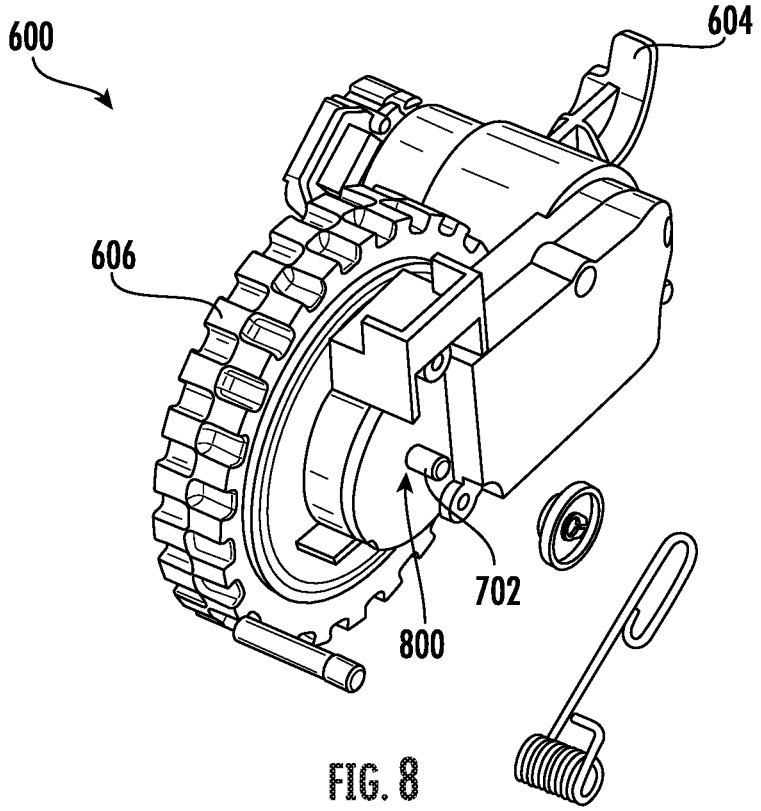
FIG. 8 is another exploded perspective view of the wheel assembly of FIG. 6, consistent with embodiments of the present disclosure.
Figure 9:
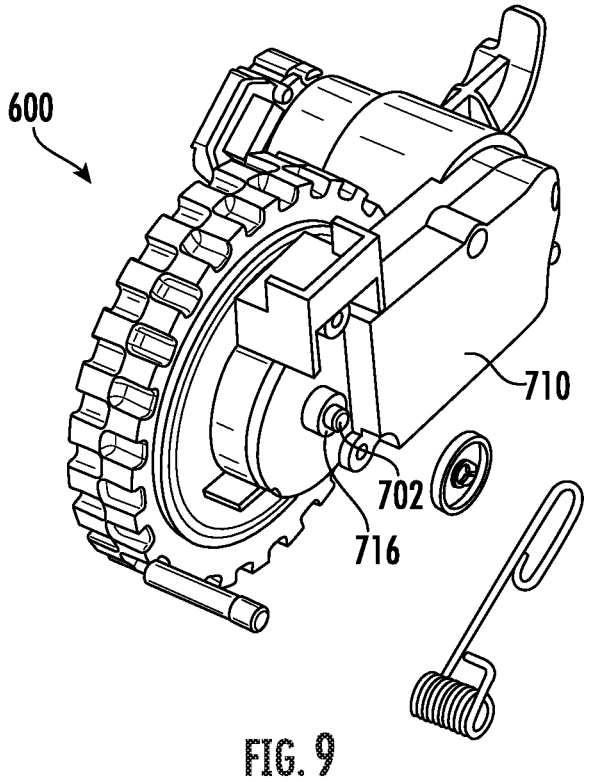
FIG. 9 is another exploded perspective view of the wheel assembly of FIG. 6, consistent with embodiments of the present disclosure.
Figure 10:
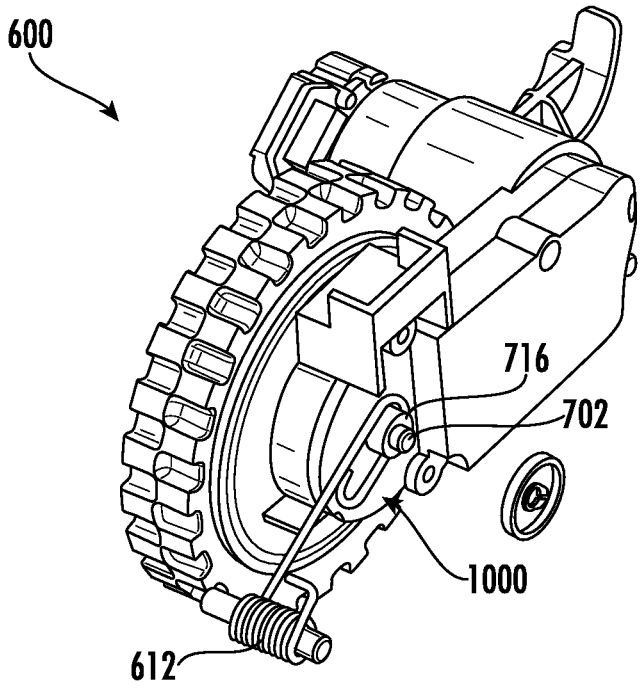
FIG. 10 is another exploded perspective view of the wheel assembly of FIG. 6, consistent with embodiments of the present disclosure.
Figure 11:
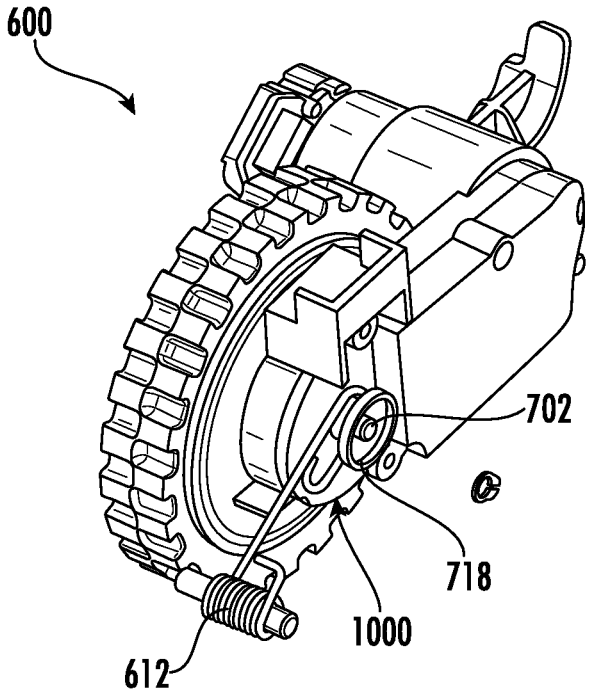
FIG. 11 is another exploded perspective view of the wheel assembly of FIG. 6, consistent with embodiments of the present disclosure.
Figure 12:
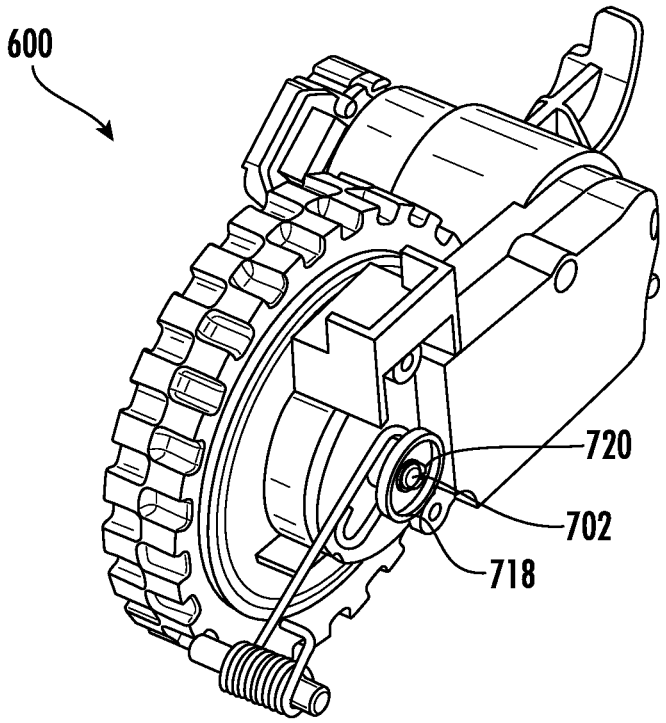
FIG. 12 is another perspective view of the wheel assembly of FIG. 6, consistent with embodiments of the present disclosure.

FIGS. 8-12 show an example of an order of assembly of the wheel assembly 600. As shown in FIG. 8, the driven wheel 606 can be rotatably coupled to the arm 604 by inserting the axle 702 in an axle opening 800 extending therethrough. As shown in FIG. 9, the spring arm bushing 716 can be positioned over at least a portion of the portion of the axle 702 extending from the drive train cover 710 after the axle 702 is received within the axle opening 800. As shown in FIG. 10, after the spring arm bushing 716 is positioned on the axle 702, a hooked portion 1000 of the torsion spring 612 can be positioned such that it extends at least partially around the spring arm bushing 716. As shown in FIG. 11, the washer 718 can be positioned on the axle 702 after the hooked portion 1000 of the torsion spring 612 is positioned over the spring arm bushing 716. As shown in FIG. 12, the snap ring 720 can be coupled to the axle 702 after the washer 718 is positioned on the axle 702.

Figure 13A:
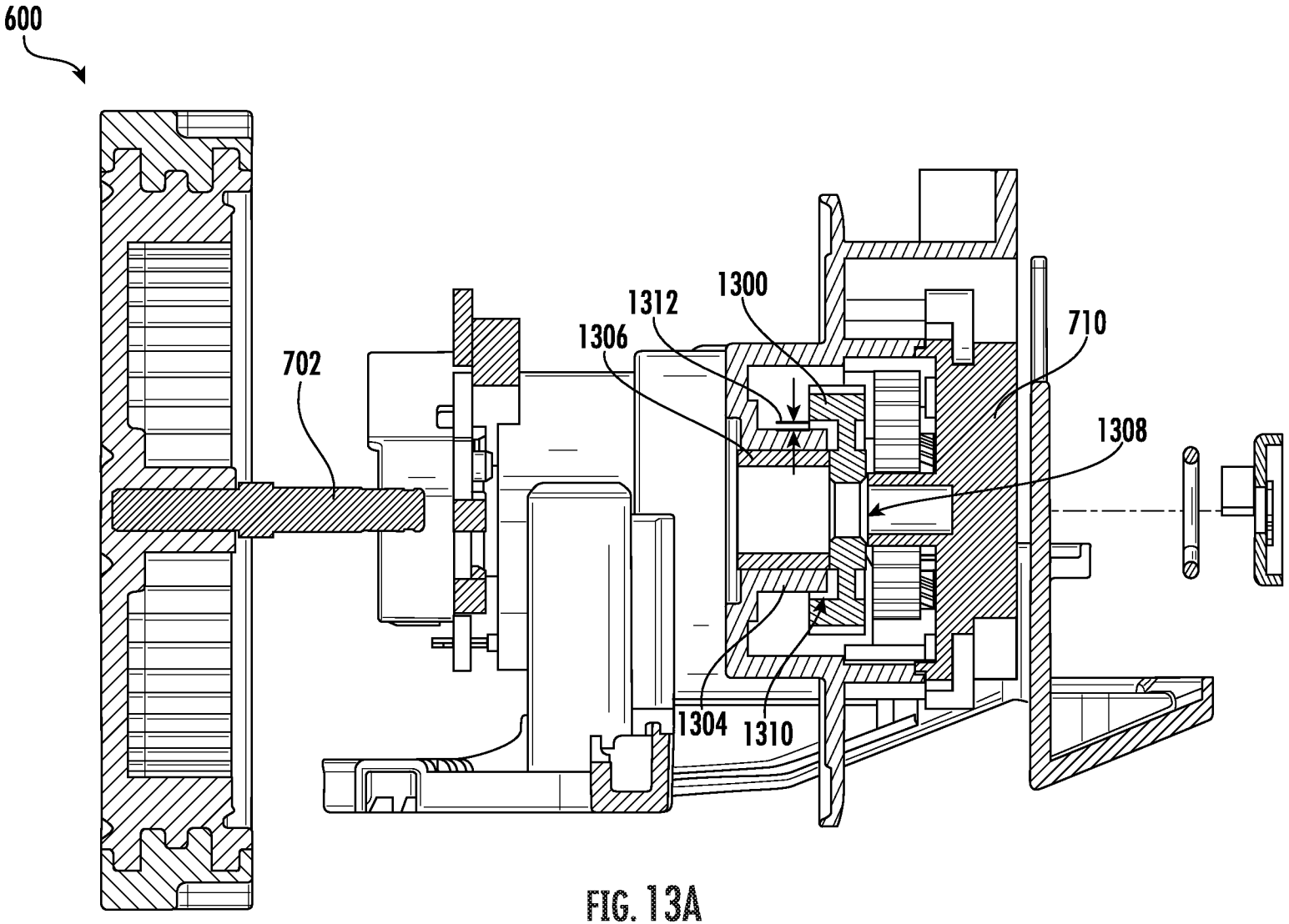
FIG. 13A is a cross-sectional perspective view of an example of the wheel assembly of FIG. 6, consistent with embodiments of the present disclosure.

FIG. 13A shows a cross-sectional view of an example of the wheel assembly 600, wherein a drive gear 1300 is configured to be coupled to the axle 702. The drive gear 1300 is disposed between a bushing receptacle 1304 for receiving an axle bushing 1306 and the drive train cover 710. The drive gear 1300 is fixed in place after the axle 702 is inserted through a drive gear opening 1308 extending therethrough. As such, the axle 702 can form a press-fit with sidewalls defining the drive gear opening 1308. As also shown, the drive gear opening 1308 can include one or more chamfers configured to urge the axle 702 and/or drive gear 1300 into alignment such that the axle 702 can be received within the drive gear opening 1308.

Figure 13B:
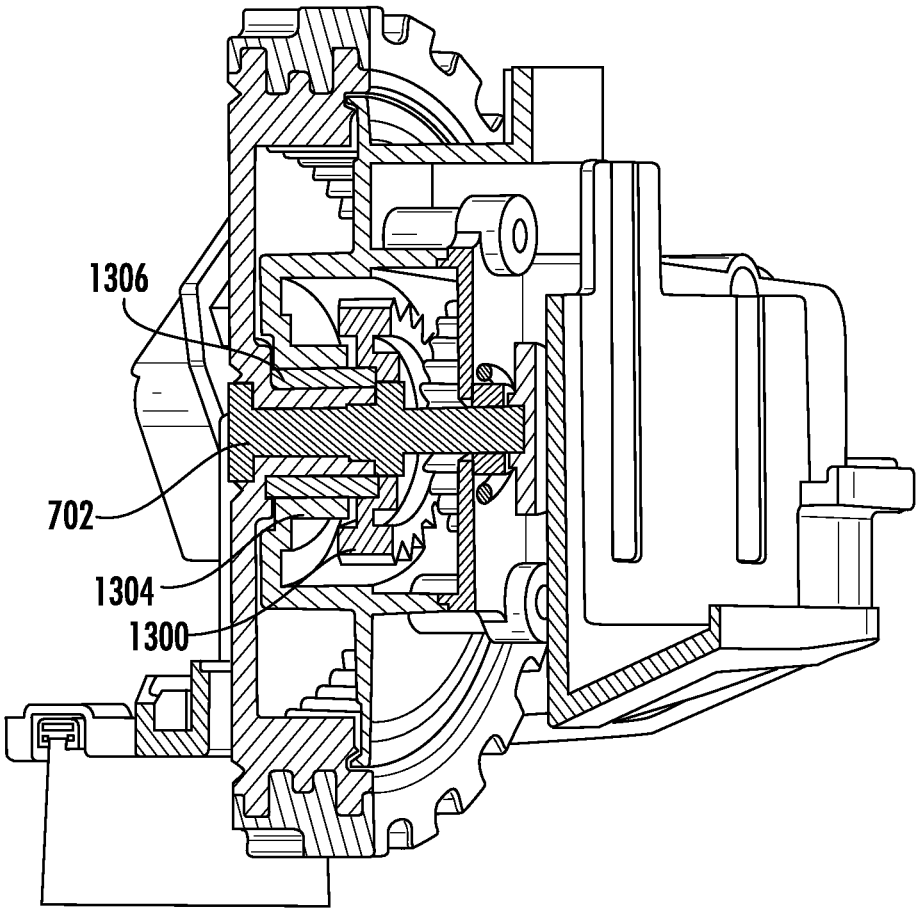
FIG. 13B is a cross-sectional perspective view of an example of the wheel assembly of FIG. 6, consistent with embodiments of the present disclosure.

In some instances, prior to being coupled to the axle 702, the drive gear 1300 can be held in place by the drive train cover 710 and the bushing receptacle 1304 (e.g., the drive gear opening 1308 is aligned relative to the axle bushing 1306 and the drive train cover 710 such that the axle 702 can pass therethrough). As shown, the drive gear 1300 can define a cavity 1310 for receiving at least a portion of the bushing receptacle 1304. A separation distance 1312 extending between an inner surface of the cavity 1310 and an outer surface of the bushing receptacle 1304 can correspond to an alignment tolerance for inserting the axle 702 into the drive gear opening 1308. Additionally, or alternatively, the axle bushing 1306 can extend from the bushing receptacle 1304 and into a corresponding receptacle defined in the drive gear 1300 (e.g., as shown in FIG. 13B). In these instances, the axle bushing 1306 can support the drive gear 1300 when the axle 702 is not coupled thereto.

In some instances, in order to reduce clearance between the axle 702 and the drive gear 1300 and/or to improve the assembly process, the drive train cover 710 and the drive gear 1300 can be assembled onto the axle 702 after the axle 702 is received within the axle bushing 1306. In other words, the axle 702 can be coupled to the drive gear 1300 before the drive train cover 710 is positioned over the drive train 610.

Figure 14:
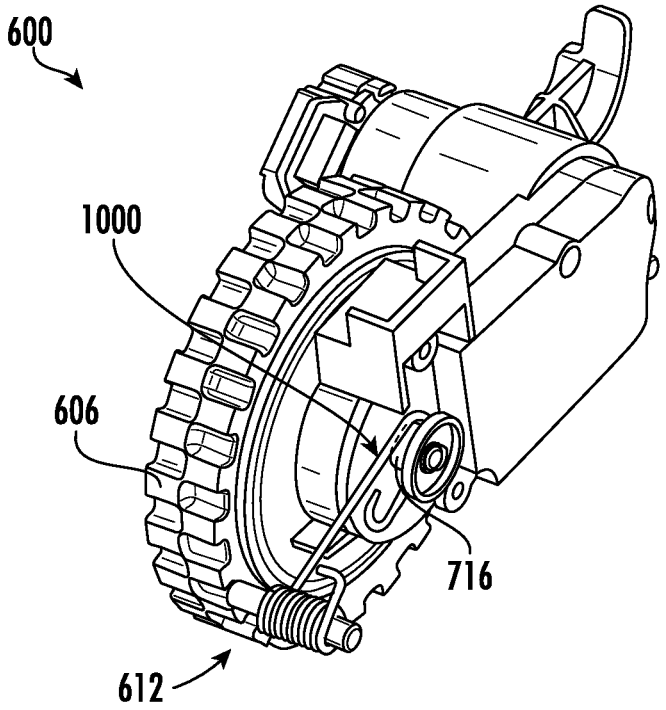
FIG. 14 is a perspective view of the wheel assembly of FIG. 6 having a driven wheel in a retracted position, consistent with embodiments of the present disclosure.
Figure 15:
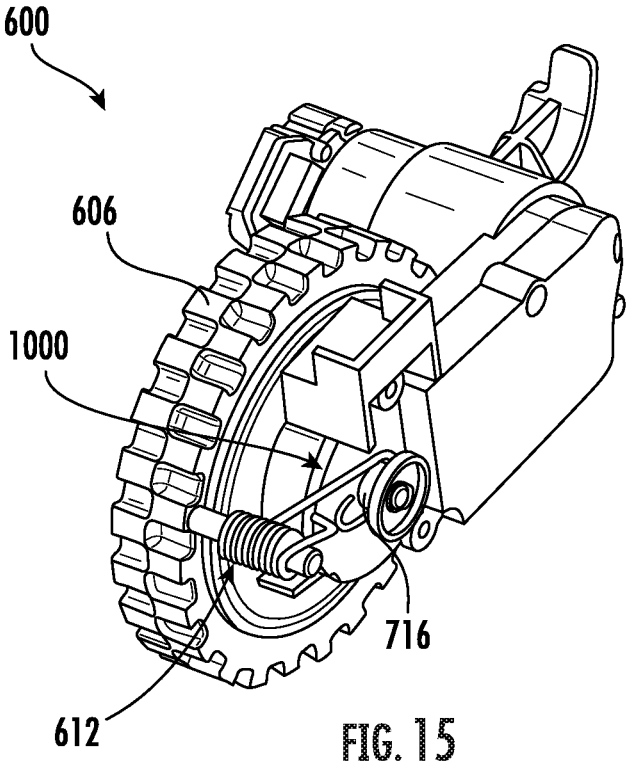
FIG. 15 is a perspective view of the wheel assembly of FIG. 6 having the driven wheel in an extended position, consistent with embodiments of the present disclosure.

FIG. 14 shows a perspective view of the wheel assembly 600 having the driven wheel 606 in a retracted position and FIG. 15 shows a perspective view of the wheel assembly 600 having the driven wheel 606 in an extended position. The frame 602 has been removed for purposes of clarity. As shown, the spring arm bushing 716 slides relative to the hooked portion 1000 of the torsion spring 612 as the driven wheel 606 transitions between the retracted and extended positions.

Figure 16:
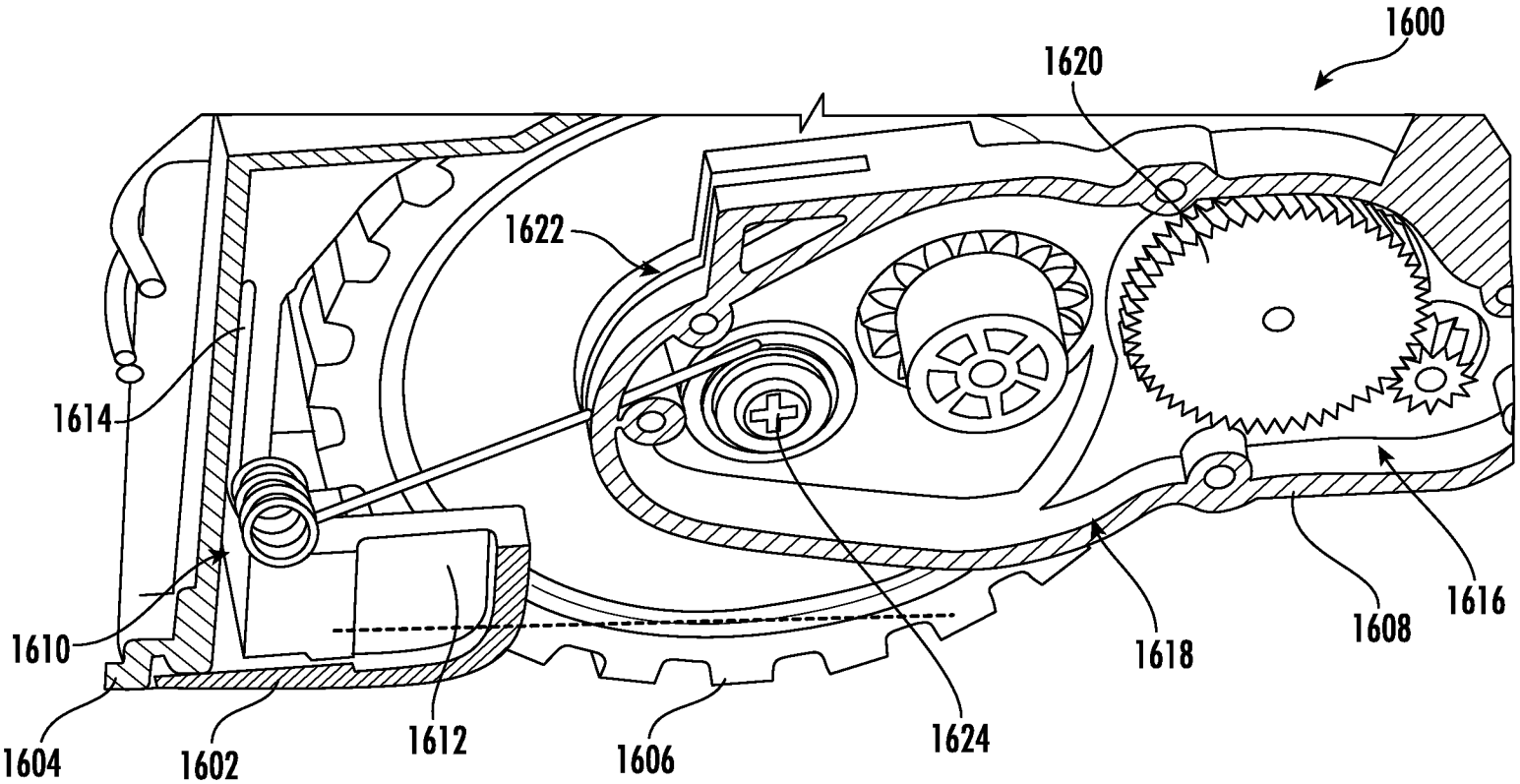
FIG. 16 is a cross-sectional perspective view of an example of a wheel assembly, consistent with embodiments of the present disclosure.

FIG. 16 shows a perspective cross-sectional view of a wheel assembly 1600, which may be an example of the wheel assembly 106 of FIG. 1. As shown, the wheel assembly 1600 includes a frame 1602 configured to be coupled to a robotic cleaner 1604 (which may be an example of the robotic cleaner 100 of FIG. 1). A driven wheel 1606 may be rotatably coupled to an arm 1608 that is pivotally coupled to the frame 1602. As such, the driven wheel 1606 is configured to pivot together with the arm 1608. A torsion spring 1610 can be coupled to the frame 1602 such that a first spring arm 1612 of the torsion spring 1610 urges the driven wheel 1606 in a direction away from the frame 1602 (e.g., in a direction of a surface to be cleaned) and a second spring arm 1614 engages the frame 1602.

A drive train 1616 can be coupled to the arm 1608 such that the drive train 1616 pivots together with the arm 1608. As shown, the arm 1608 can define a cavity 1618 for receiving one or more gears 1620 of the drive train 1616. The arm 1608 can define a slot 1622 for receiving at least a portion of the first spring arm 1612 such that at least a portion of the first spring arm 1612 extends within the cavity 1618. As such, the first spring arm 1612 can extend proximate to an axle 1624 extending from the driven wheel 1606. For example, the first spring arm 1612 can directly or indirectly engage the axle 1624.

The slot 1622 can include a resiliently deformable seal to reduce or prevent the ingress of the debris into the cavity 1618. The resiliently deformable seal can be configured such that the resiliently deformable seal does not substantially interfere with the movement of the first spring arm 1612 relative to the resiliently deformable seal.

Figure 17:
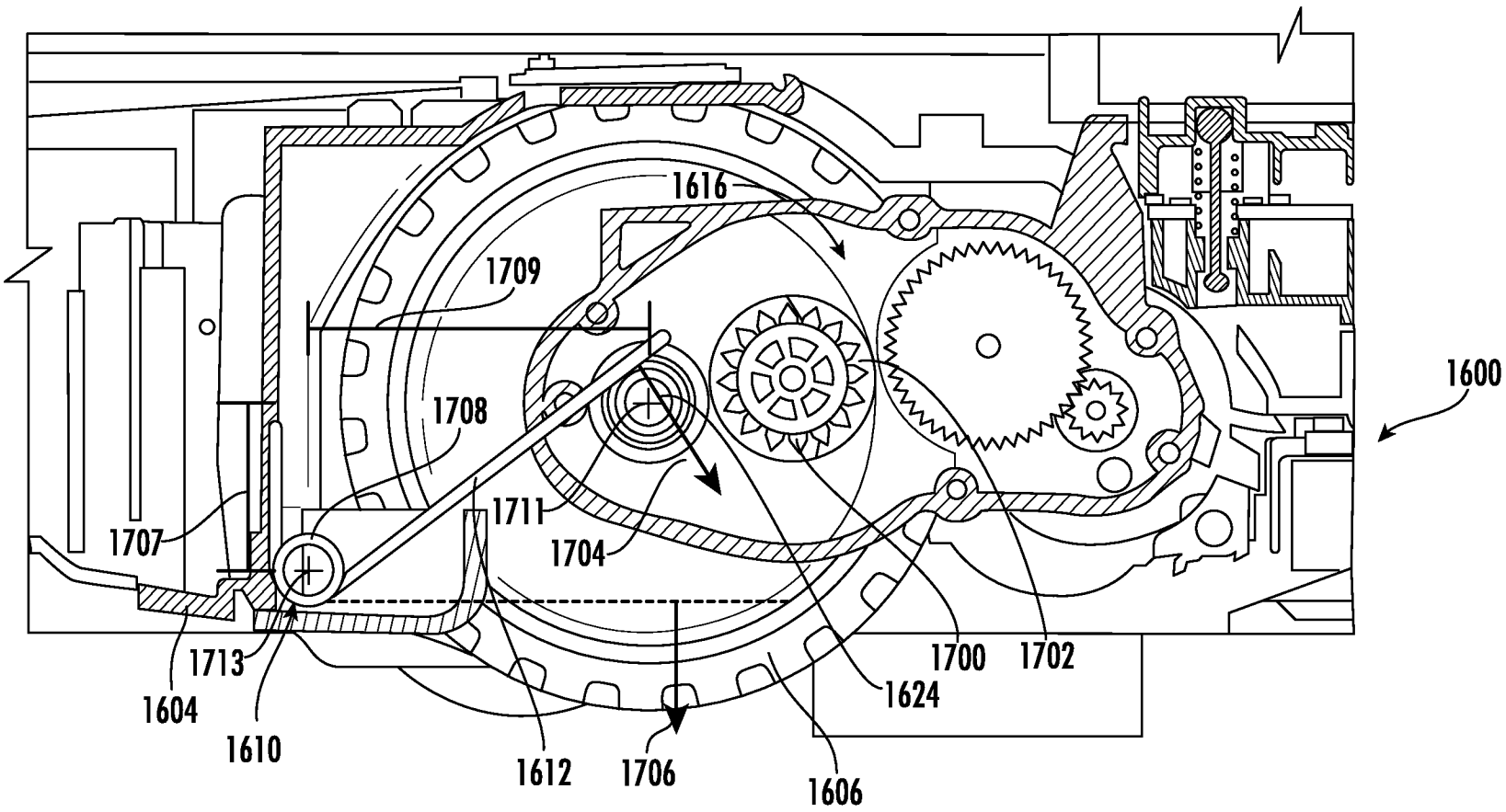
FIG. 17 is a cross-sectional side view of the wheel assembly of FIG. 16, consistent with embodiments of the present disclosure.

FIG. 17 shows a cross-sectional side view of the wheel assembly 1600 disposed within the robotic cleaner 1604. As shown, the first spring arm 1612 of the torsion spring 1610 directly engages the axle 1624. In these instances, a lubricant (e.g., a grease or an oil) may be applied to one or more of the torsion spring 1610 and/or the axle 1624 to reduce wear caused by rubbing. In some instances, the first spring arm 1612 of the torsion spring 1610 can indirectly engage the axle 1624. For example, a bushing may extend around the axle 1624 such that the first spring arm 1612 directly engages the bushing.

The torsion spring 1610 can be coupled to the frame 1602 of the wheel assembly 1600 at a location that maximizes a separation distance (e.g., a vertical and/or horizontal separation distance 1707 and 1709) between a rotation axis 1711 of the driven wheel 1606 and a spring axis 1713 extending through a coiled portion 1708 of the torsion spring 1610 when the driven wheel 1606 is in the retracted position and minimizes a separation distance between the spring axis 1713 and a surface to be cleaned. Such a configuration may maximize the force exerted on the driven wheel 1606 and may result in a more consistent application of the exerted force.

As shown, when the driven wheel 1606 is in the retracted position, the torsion spring 1610 may exert a force along a vector 1704. As the driven wheel 1606 transitions to an extended position, a vector along which the force is exerted by the torsion spring 1610 may change. For example, when the driven wheel 1606 is in the extended position, the torsion spring 1610 may exert the force along force a vector 1706. The nature and/or rate of change in the vectors when transitioning from the retracted to the extended position may be based, at least in part, on one or more of the coupling location of the torsion spring 1610 (e.g., the location of the spring axis 1713), the location of the axle 1624, and/or the location about which the arm 1608 pivots.

As also shown, the drive train 1616 includes a sun gear 1700 configured to engage a corresponding planet gear 1702 defined along an inner surface of the driven wheel 1606. As such, a rotation of the sun gear 1700 causes a corresponding rotation of the driven wheel 1606.

An example of a wheel assembly for a robotic cleaner consistent with the present disclosure may include a frame, a moveable arm pivotally coupled to the frame, a driven wheel rotatably coupled to the moveable arm such that the driven wheel pivots with the arm, and a biasing mechanism configured to urge the driven wheel towards an extended position, the biasing mechanism being coupled to the frame and spaced apart from the moveable arm.

In some instances, the wheel assembly may further include a power train coupled to the moveable arm such that the power train pivots with the moveable arm, wherein the power train includes a drive motor and a drive train, the drive train including one or more gears. In some instances, the biasing mechanism may directly engage a bushing, the bushing extending around an axle coupled to the driven wheel. In some instances, the biasing mechanism may include a torsion spring. In some instances, the torsion spring may include a first spring arm configured to urge the driven wheel towards the extended position and a second spring arm configured to engage the frame. In some instances, the driven wheel may include an axle extending therefrom, the axle rotating with the driven wheel. In some instances, a bushing may extend around the axle. In some instances, the torsion spring may include a first spring arm configured to engage the bushing. In some instances, the axle may include a first end and a second end and the driven wheel may include a hub configured to receive the second end. In some instances, the hub may be over-molded over at least a portion of the axle. In some instances, the wheel assembly may also include a power train coupled to the moveable arm such that the power train pivots with the moveable arm, wherein the power train includes a drive train having a drive train cover. In some instances, the first end of the axle may extend from the drive train cover by an extension distance. In some instances, the bushing may be disposed between the drive train cover and the first end of the axle.

An example of a robotic cleaner consistent with the present disclosure may include a body, a wheel assembly coupled to the body, and a torsion spring. The wheel assembly may include a frame, a moveable arm pivotally coupled to the frame, and a driven wheel rotatably coupled to the moveable arm such that the driven wheel pivots with the moveable arm. The torsion spring may be configured to urge the driven wheel towards an extended position.

In some instances, the torsion spring may include a first spring arm configured to urge the driven wheel towards the extended position and a second spring arm configured to engage the frame. In some instances, the driven wheel may include an axle extending therefrom, the axle rotating with the driven wheel. In some instances, a bushing may extend around the axle. In some instances, the torsion spring may include a first spring arm configured to engage the bushing. In some instances, the axle may include a first end and a second end and the driven wheel may include a hub configured to receive the second end. In some instances, the hub may be over-molded over at least a portion of the axle.

While the present disclosure generally discloses a wheel assembly for use with a robotic cleaner, the wheel assembly may also be used in other autonomous devices. For example, the wheel assembly may be used with robotic lawn mowers, robotic telepresence devices, and/or the like.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A wheel assembly for a robotic cleaner comprising:

a frame;

a moveable arm pivotally coupled to the frame;

a driven wheel rotatably coupled to the moveable arm such that the driven wheel pivots with the moveable arm;

a pin coupled to the frame; and a torsion spring that includes a coiled portion that extends around the pin, the torsion spring configured to urge the driven wheel towards an extended position, the torsion spring being spaced apart from the moveable arm, wherein the moveable arm is configured to pivot such that a rotation axis of the driven wheel transitions between a position vertically above the pin and a position vertically below the pin.

2. The wheel assembly of claim 1, further comprising a power train coupled to the moveable arm such that the power train pivots with the moveable arm, wherein the power train includes a drive motor and a drive train, the drive train including one or more gears.

3. The wheel assembly of claim 1, wherein the torsion spring directly engages a bushing, the bushing extending around an axle coupled to the driven wheel.

4. The wheel assembly of claim 1, wherein the torsion spring includes a first spring arm configured to urge the driven wheel towards the extended position and a second spring arm configured to engage the frame.

5. The wheel assembly of claim 4, wherein the driven wheel includes an axle extending therefrom, the axle rotating with the driven wheel.

6. The wheel assembly of claim 5, wherein a bushing extends around the axle.

7. The wheel assembly of claim 6, wherein the first spring arm is configured to engage the bushing.

8. The wheel assembly of claim 7, wherein the axle includes a first end and a second end and the driven wheel includes a hub configured to receive the second end.

9. The wheel assembly of claim 8, wherein the hub is over-molded over at least a portion of the axle.

10. The wheel assembly of claim 8 further comprising a power train coupled to the moveable arm such that the power train pivots with the moveable arm, wherein the power train includes a drive train having a drive train cover.

11. The wheel assembly of claim 10, wherein the first end of the axle extends from the drive train cover by an extension distance.

12. The wheel assembly of claim 11, wherein the bushing is disposed between the drive train cover and the first end of the axle.

13. A robotic cleaner comprising:

a body;

a wheel assembly coupled to the body, the wheel assembly comprising:

a frame;

a pin coupled to the frame;

a moveable arm pivotally coupled to the frame; and a driven wheel rotatably coupled to the moveable arm such that the driven wheel pivots with the moveable arm; and a torsion spring configured to urge the driven wheel towards an extended position, the torsion spring including a coiled portion that extends around the pin, wherein the moveable arm is configured to pivot such that a rotation axis of the driven wheel transitions between a position vertically above the pin and a position vertically below the pin.

14. The robotic cleaner of claim 13, wherein the torsion spring includes a first spring arm configured to urge the driven wheel towards the extended position and a second spring arm configured to engage the frame.

15. The robotic cleaner of claim 13, wherein the driven wheel includes an axle extending therefrom, the axle rotating with the driven wheel.

16. The robotic cleaner of claim 15, wherein a bushing extends around the axle.

17. The robotic cleaner of claim 16, wherein the torsion spring includes a first spring arm configured to engage the bushing.

18. The robotic cleaner of claim 17, wherein the axle includes a first end and a second end and the driven wheel includes a hub configured to receive the second end.

19. The robotic cleaner of claim 18, wherein the hub is over-molded over at least a portion of the axle.

* * * * *